US012674300B2

(12) United States Patent
Wu et al.

(10) Patent No.: US 12,674,300 B2
(45) Date of Patent: Jul. 7, 2026

(54) ROBOT FOR POND DESILTING

(71) Applicants: GUANGDONG OCEAN UNIVERSITY, Zhanjiang (CN); Zhanjiang Guanghai Lvyu Intelligent Technology Co., Ltd, Zhanjiang (CN)

(72) Inventors: Guanglin Wu, Zhanjiang (CN); Mingxian Wang, Zhanjiang (CN); Jinbo Lin, Zhanjiang (CN); Hongfei Mao, Zhanjiang (CN); Yifang Sun, Zhanjiang (CN); Qinglong Chen, Zhanjiang (CN); Ruixin Liu, Zhanjiang (CN); Haoyu Tan, Zhanjiang (CN); Jiaxin Li, Zhanjiang (CN); Hailing Zhou, Zhanjiang (CN)

(73) Assignees: GUANGDONG OCEAN UNIVERSITY, Zhanjiang (CN); Zhanjiang Guanghai Lvyu Intelligent Technology Co., Ltd, Zhanjiang (CN)

( * ) Notice: Subject to any disclaimer, the term of this patent is extended or adjusted under 35 U.S.C. 154(b) by 369 days.

(21) Appl. No.: 18/396,746

(22) Filed: Dec. 27, 2023

(65) Prior Publication Data

US 2024/0159015 A1 May 16, 2024

Related U.S. Application Data

(63) Continuation of application No. PCT/CN2023/103001, filed on Jun. 28, 2023.

(30) Foreign Application Priority Data

Nov. 10, 2022 (CN) ..... 202211405965.X

(51) Int. Cl.
*E02F 3/92* (2006.01)
*E02F 5/28* (2006.01)

(52) U.S. Cl.
CPC ..... *E02F 3/9243* (2013.01); *E02F 5/282* (2013.01)

(58) Field of Classification Search
CPC ..... E02F 3/9243; E02F 3/92; E02F 3/8858; E02F 3/8866; E02F 3/88; E02F 5/28; E02F 5/282
(Continued)

(56) References Cited

U.S. PATENT DOCUMENTS 3,659,712 A * 5/1972 Chaplin ..... E02F 3/92 210/744

FOREIGN PATENT DOCUMENTS

CN 109098220 A 12/2018
CN 110871448 A * 3/2020 ..... H04N 23/74
(Continued)

OTHER PUBLICATIONS

CN-110871448-A (Year: 2020).*

*Primary Examiner* — Christopher J Sebesta
*Assistant Examiner* — Evan A Bregel
(74) *Attorney, Agent, or Firm* — Hemisphere Law, PLLC

(57) ABSTRACT

A robot for pond desilting is provided, which includes a frame, a lead screw sliding table, and a suction pipe. An end of the frame is provided with a pressure-resistant cabin. A lead screw base is disposed on the lead screw sliding table. A rotary lead screw is disposed on the lead screw sliding table. The lead screw base is disposed on the rotary lead screw. Waterproof motors are disposed above the lead screw base, a pump body is disposed in the frame, and the suction pipe is disposed at an end of the pump body. When the robot is placed at the bottom of the pond, the motor inside the pressure-resistant cabin drives the power wheels to rotate,
(Continued)

the power wheels drive the tracks to rotate around the power wheels, bearing wheels, and tension wheels, thereby driving the frame to move.

9 Claims, 7 Drawing Sheets

(58) Field of Classification Search
USPC ..... 37/343, 344, 307, 313, 317
See application file for complete search history.

(56) References Cited

FOREIGN PATENT DOCUMENTS

| | | | |
|---|---|---|---|
| CN | 212104269 | U | 12/2020 |
| CN | 214301920 | | 9/2021 |
| CN | 215253100 | | 12/2021 |
| CN | 114045894 | A | 2/2022 |
| CN | 216567793 | | 5/2022 |

* cited by examiner

ROBOT FOR POND DESILTING

TECHNICAL FIELD

The disclosure relates to the technical field of pond desilting, and particularly to a robot for pond desilting.

BACKGROUND

Silt accumulation in a pond increased at the rate of 10~15 centimeters (cm) every year. Accumulation of feed residues, feces of fishes, and feces of shrimps will cause eutrophication of water bodies. The hazards of eutrophication of water bodies to fishes and economic aquatic organisms are as follows: dissolved oxygen in the water bodies is very low and leads to death by suffocation, and toxins released by algal death after algal bloom lead to the death of fishes.

There are three types of mechanical desilting methods for fish ponds, namely a method of using underwater desilting machine, a dry desilting method and a semi-dry desilting method. Specifically, the underwater dredging machine can work underwater without affecting the normal farming of fishes and shrimps, but underwater dredging machine cannot control a desilting thickness, and silt cannot be pumped ashore in time, thereby resulting in water pollution. Both the dry desilting method and the semi-dry desilting method pump out water in the pond for operation, which affects the normal farming of fishes and shrimps.

SUMMARY

The purpose of the disclosure is to provide a robot for pond desilting to solve the problems of the related art.

To achieve the above purpose, the disclosure provides the following technical solution: a robot for pond desilting which includes a frame, a lead screw sliding table, and a suction pipe. An end of the frame is provided with a pressure-resistant cabin. A lead screw base is disposed on the lead screw sliding table. A rotary lead screw is disposed on the lead screw sliding table. The lead screw base is disposed on the rotary lead screw. The lead screw sliding table is connected to the frame. Waterproof motors are disposed above the lead screw base. A pump body is disposed in the frame. The suction pipe is disposed at an end of the pump body.

In an embodiment, a motor is disposed in the pressure-resistant cabin. Ends of the motor are connected to power wheels respectively. A sealing rubber ring and a sealing cabin cover are disposed on the pressure-resistant cabin. The sealing rubber ring and the sealing cabin cover are fixed on the pressure-resistant cabin through screws. Tracks are sleeved on the power wheels respectively, and tension wheels and bearing wheels are disposed on the frame.

In an embodiment, the tension wheels and the bearing wheels are rotatably connected to the frame. The tracks are sleeved on the tension wheels and the bearing wheels. The tension wheels and the bearing wheels are configured to rotate besides the frame. The tracks are configured to rotate on surfaces of the tension wheels, surfaces of the bearing wheels, and surfaces of the power wheels. Bottoms of the tracks are configured for being in contact with a bottom of a pond when the robot for pond desilting is operated in the pond.

In an embodiment, another end of the pump body is configured for connecting to a pipeline, and the pipeline is configured to extend outside a pond when the robot for pond desilting is operated in the pond. An end of the suction pipe is provided with a filter. The pump body is configured to pump silt and water into the suction pipe, and the silt and the water are discharged through the pipeline. Specifically, the pump body may be a submersible slurry pump with a model number 50ZJQ25-15.

In an embodiment, the lead screw sliding table is fixed on another end of the frame. Limited sliding rails are disposed on the lead screw sliding table. The lead screw base is provided with limited grooves. The limited sliding rails are matched with the limited grooves, the lead screw base is configured to slide on the lead screw sliding table, the rotary lead screw is configured for connecting to a driving device, and the driving device is configured to drive the rotary lead screw to slide on the lead screw sliding table.

In an embodiment, the rotary lead screw is disposed between the lead screw base and the lead screw sliding table. The rotary lead screw is configured to rotate to drive the lead screw base to move on the lead screw sliding table, the waterproof motors are disposed above the lead screw base, an end of each of the waterproof motors is provided with a reamer, the waterproof motor is configured to rotate the reamer, and an extension block is disposed on the lead screw base.

In an embodiment, a triangular plate is disposed on the extension block. A section of the triangular plate is triangular. A bottom of the triangular plate is provided with multiple barrier rods. A section of each of the multiple barrier rods includes a triangle and a semicircle. The multiple barrier rods are evenly arranged at the bottom of the triangular plate.

In an embodiment, a bottom of each of the multiple barrier rods is provided with a casing pipe. A bottom of the casing pipe is provided with a ball. The casing pipe is provided with an inserting groove. The bottom of the barrier rod is inserted in the inserting groove. The barrier rod is configured to move in the inserting groove. A spring is disposed in the inserting groove.

In an embodiment, an end of the spring is connected to the bottom of the barrier rod. Another end of the spring is connected to an inner wall of the insertion groove. A bottom of the extension block is provided with a waterproof cylinder. An end of the waterproof cylinder is connected to a sliding block. The bottom of the extension block is provided with a sliding groove. The sliding block is located in the sliding groove, and the sliding block is configured to move in the sliding groove.

In an embodiment, a movable plate is disposed on the sliding block. The movable is provided with multiple push plates, and a part of the each of the multiple push plates is arc-shaped.

Compared with the related art, the beneficial effects of the disclosure are as follows.

When the robot of the disclosure is placed at the bottom of the pond, the motor inside the pressure-resistant cabin drives the power wheels to rotate, the power wheels drive the tracks to rotate around the power wheels, bearing wheels, and tension wheels, thereby driving the frame to move. During the movement of the robot at the bottom of the pond, the waterproof motors drive the reamers to rotate for crushing the silt at the bottom of the pond. Then, the pump body sucks the silt out of the pond through the suction pipe, and the waterproof motors are installed above the lead screw base, so that the waterproof motors can be lifted and lowered by moving the lead screw base on the lead screw sliding table, which facilitates the insertion of the reamer into the silt to crush the silt. The waterproof motors are located at the rear of the frame to prevent the robot from getting stuck and unable to move. The disclosure can clear the silt from the pond without affecting the normal farming of fishes and shrimps.

DESCRIPTION OF REFERENCE NUMERALS

Figure 1:
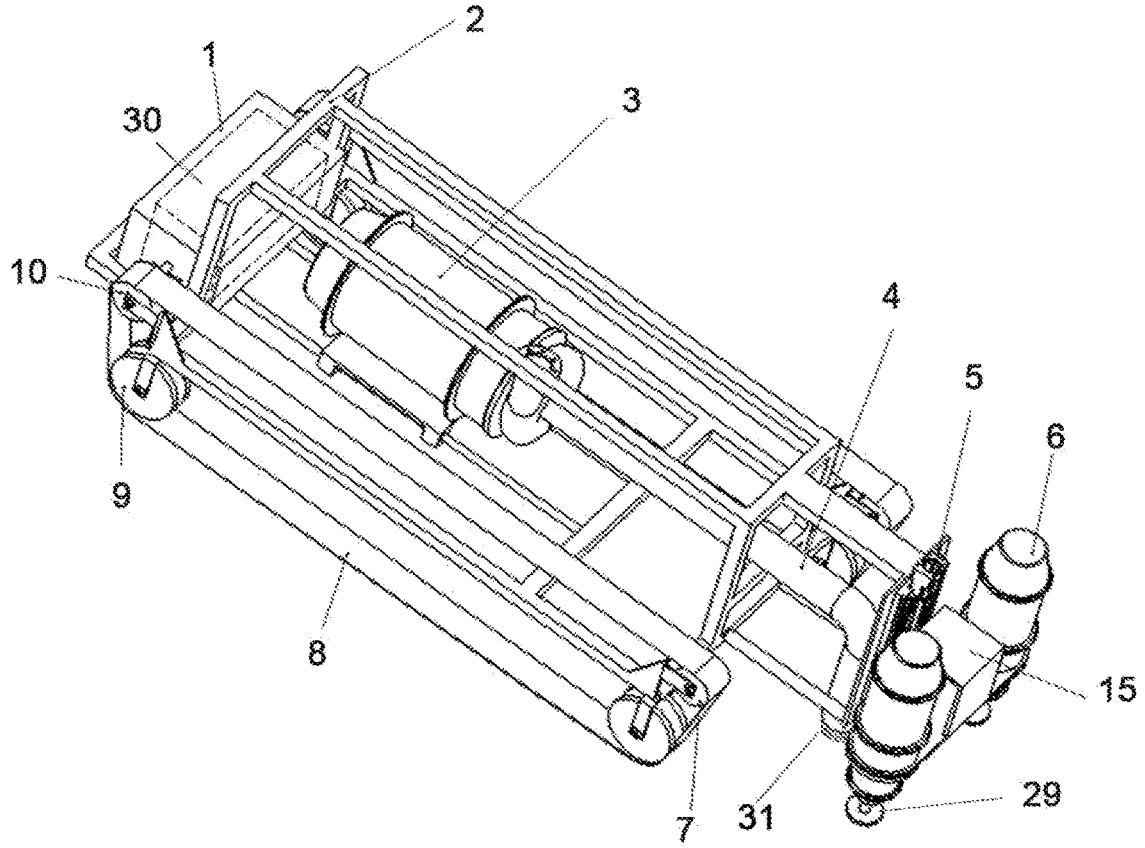
FIG. 1 illustrates a schematic structural diagram of the robot for pond desilting provided by the disclosure.
Figure 2:
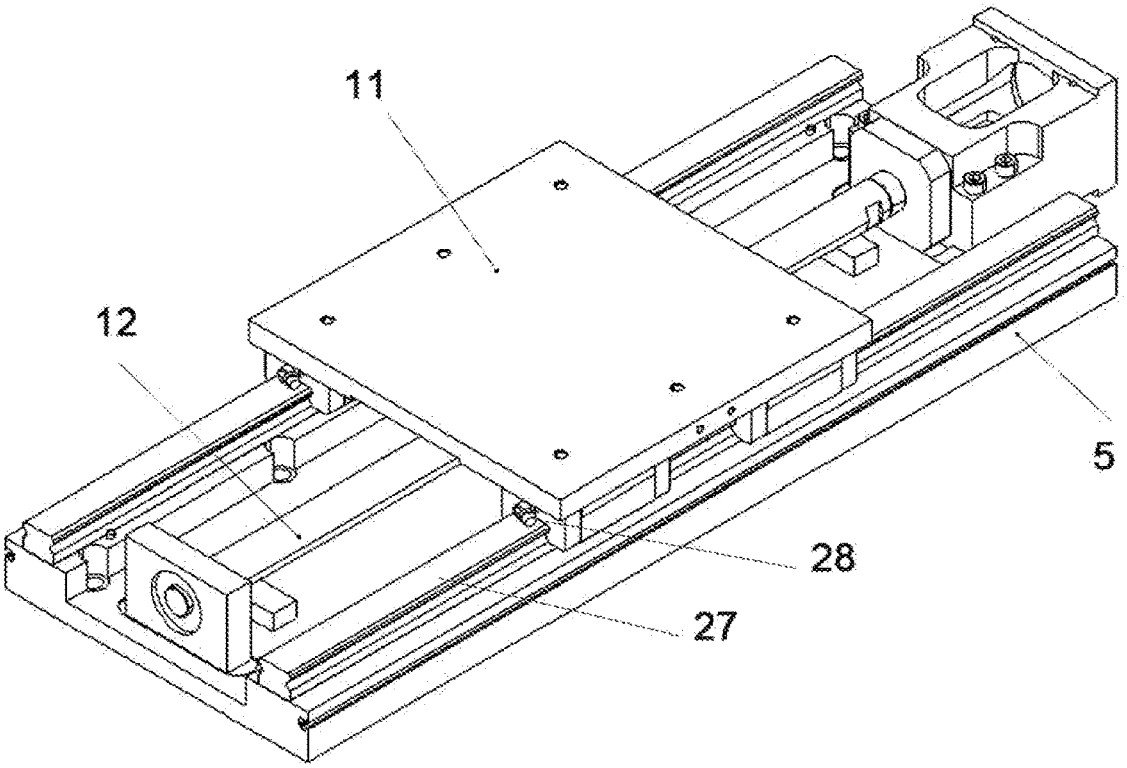
FIG. 2 illustrates a schematic structural diagram of a lead screw sliding table of the disclosure.
Figure 3:
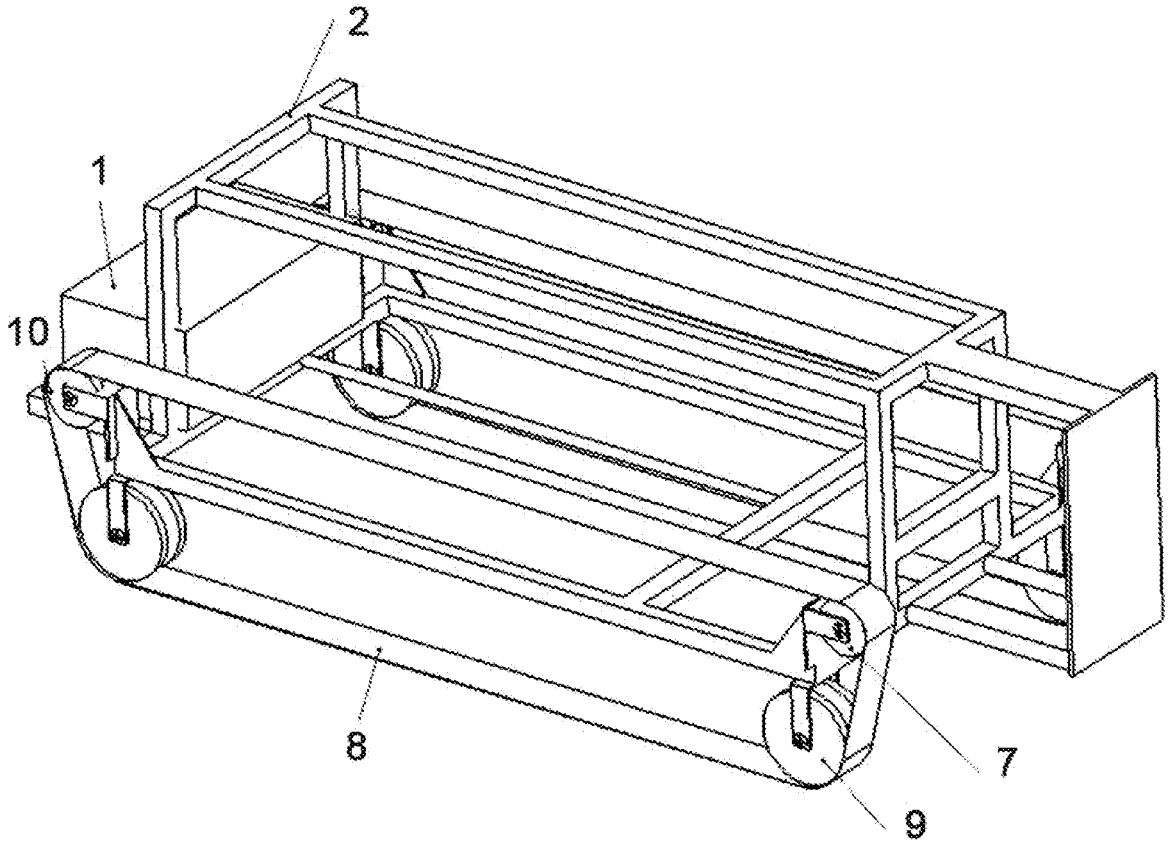
FIG. 3 illustrates a schematic structural diagram of a frame of the disclosure.

1—pressure-resistant cabin; 2—frame; 3—pump body; 4—suction pipe; 5—lead screw sliding table; 6—waterproof motor; 7—tension wheel; 8—track; 9—bearing wheel; 10—power wheel; 11—lead screw base; 12—rotary lead screw; 13—sealing rubber ring; 14—sealing cabin cover; 15—extension block; 16—triangular plate; 17—barrier rod; 18—inserting groove; 19—spring; 20—ball; 21—casing pipe; 22—push plate; 23—waterproof cylinder; 24—movable plate; 25—sliding block; 26—sliding groove; 27—limited sliding rail; 28—limited groove; 29—reamer; 30—motor; 31—filter; 32—screw.

DETAILED DESCRIPTION OF EMBODIMENTS

In order to clearly and completely describe the purpose and technical solution of the disclosure, and to more clearly understand the advantages thereof, the embodiments of the disclosure are further described in detail below with reference to the accompanying drawings. It should be understood that the specific embodiments described herein are only a part of the embodiments of the disclosure, not all of the embodiments, and the specific embodiments are only used to explain the principle the disclosure, not to limit the disclosure. All other embodiments obtained by those of ordinary skill in the art without creative work should belong to the scope of protection of the disclosure.

In the description of the disclosure, it should be noted that the orientation or positional relationship indicated by terms "center", "middle", "upper", "lower", "left", "right", "inner", and "outer" are based on the orientation or positional relationship shown in the drawings, and are only for conveniently describing the disclosure and simplifying the description of the disclosure. It is not intended to indicate or imply that the devices or elements referred to must have a particular orientation, be constructed in a particular orientation, and operate in a particular manner, and therefore these terms should not be considered as a limitation of the disclosure. Furthermore, terms "a", "first", "second", "third", "fourth", "fifth", and "sixth" are only used for descriptive purposes and are not to be considered as indicating or implying relative importance.

In the description of the disclosure, it should be noted that unless otherwise specified and limited, terms "install", "connect", and "communicate" should be understood broadly. For example, they can be fixed connections, detachable connections, or integrated connections. They can be mechanical connections or electrical connections. They can be direct connections, or indirect connections through intermediate media, or they can be internal connections between two components. For those skilled in the art, the specific meanings of the above terms in the disclosure can be understood in specific situations.

For purposes of brevity and explanation, the principle of the disclosure is described primarily with reference to embodiments. In the following description, specific details are set forth to provide a clear understanding of the embodiments for those of ordinary skill in the art. Apparently, for those of ordinary skill in the art, the embodiments are not limited to these specific details in actual situations. In some embodiments, there is no detailed description of well-known methods and structures to avoid these embodiments becoming difficult to understand. Additionally, all embodiments can be used in conjunction with each other.

Figure 4:
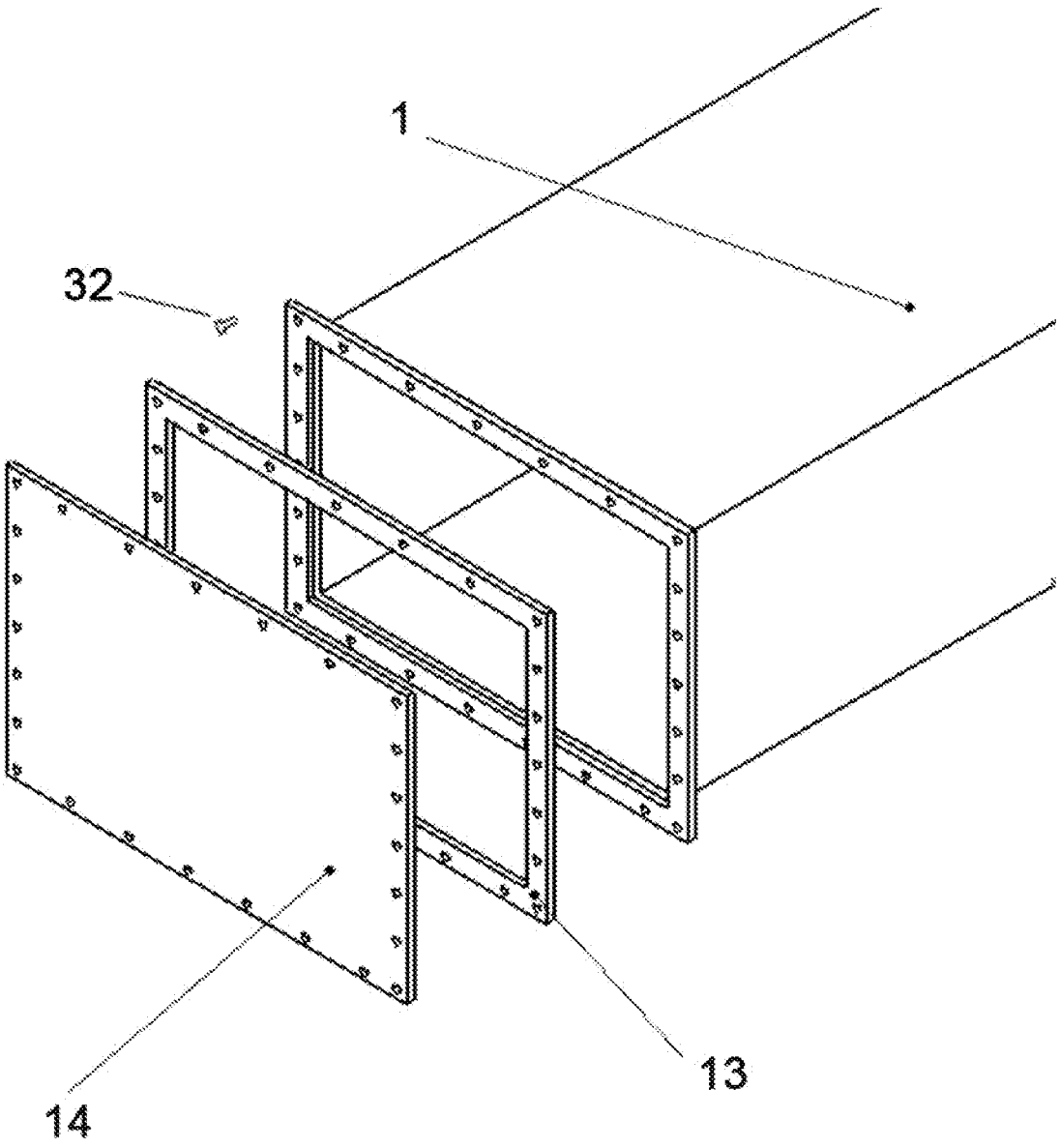
FIG. 4 illustrates a schematic structural diagram of a pressure-resistant cabin of the disclosure.
Figure 5:
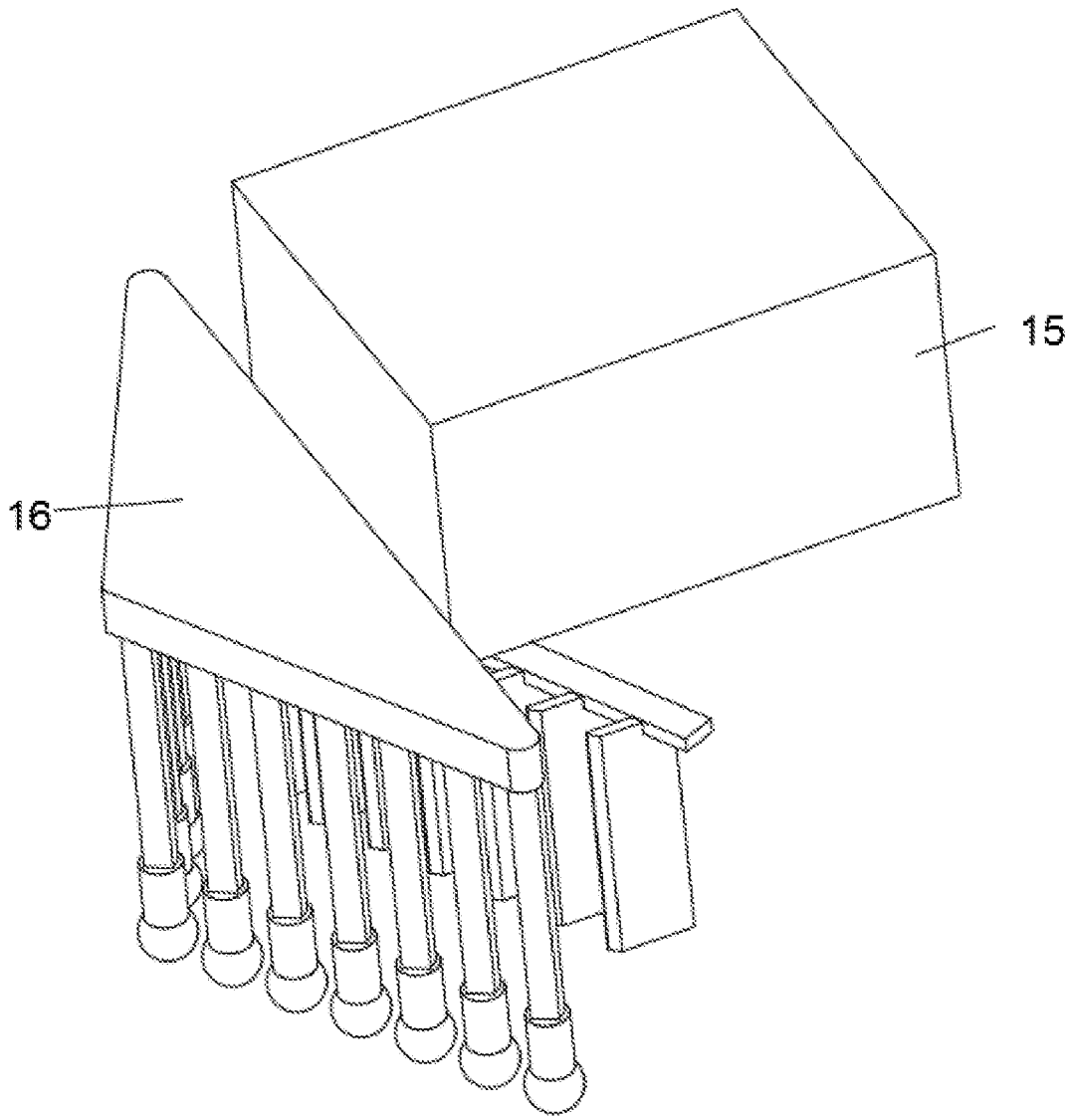
FIG. 5 illustrates a schematic structural diagram of an extension block of the disclosure.
Figure 6:
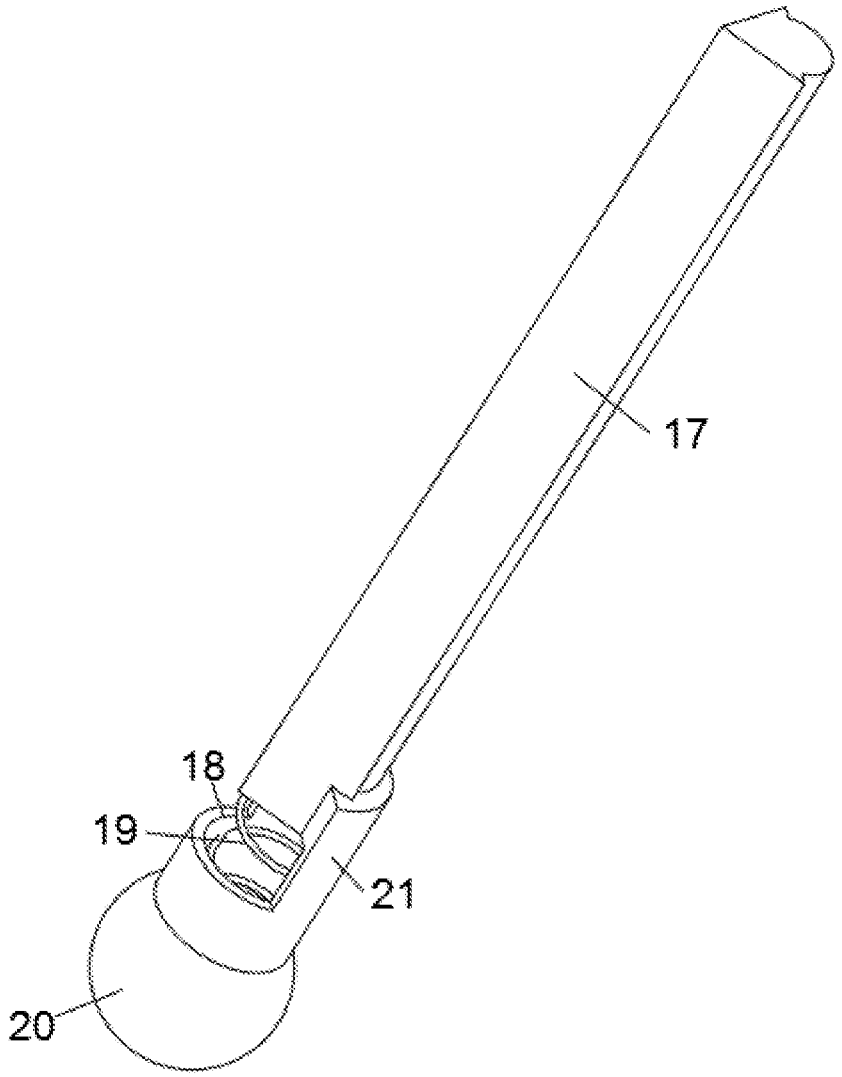
FIG. 6 illustrates a schematic structural diagram of a barrier rod of the disclosure.
Figure 7:
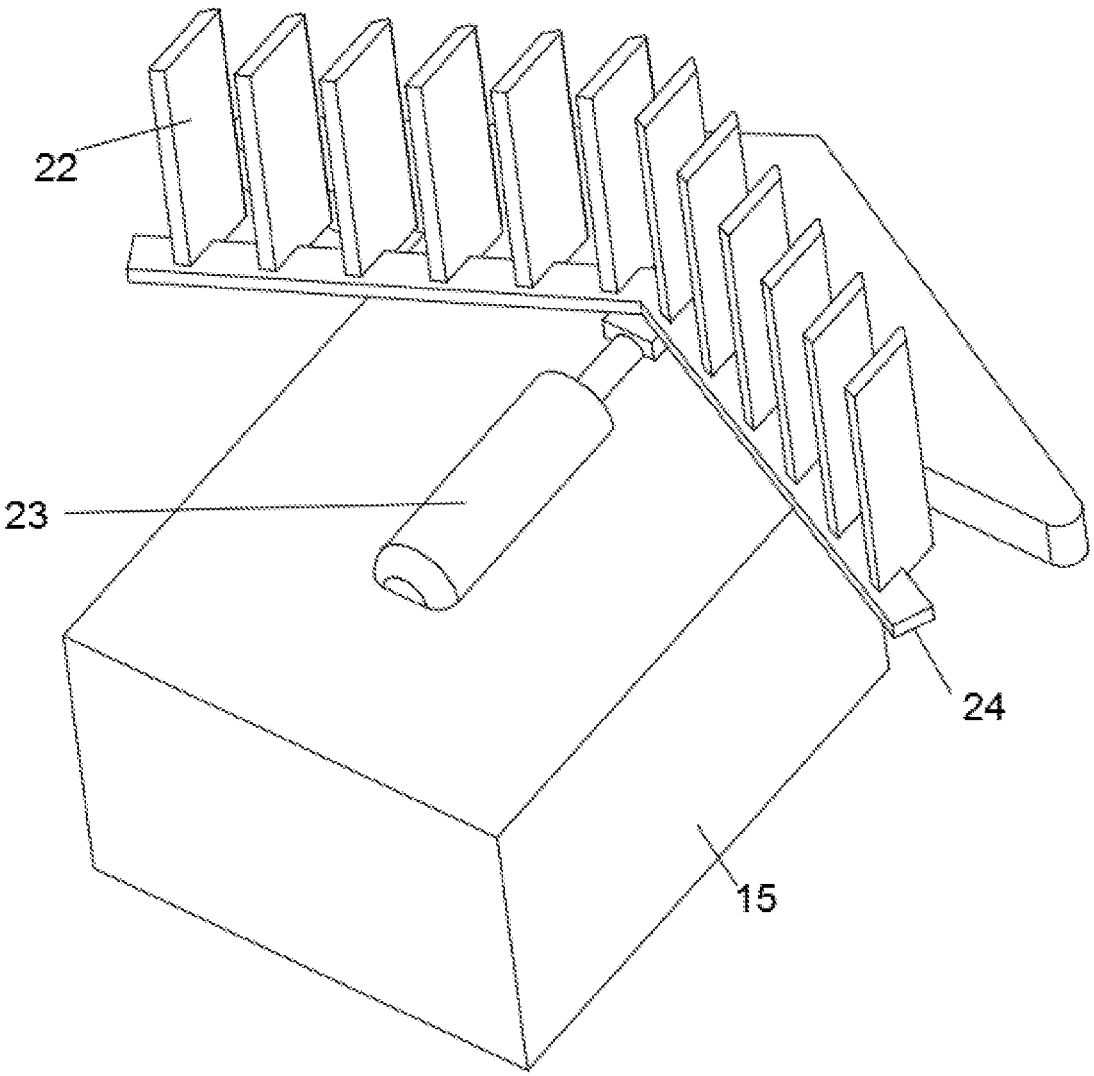
FIG. 7 illustrates a schematic structural diagram of a push plate of the disclosure.
Figure 8:
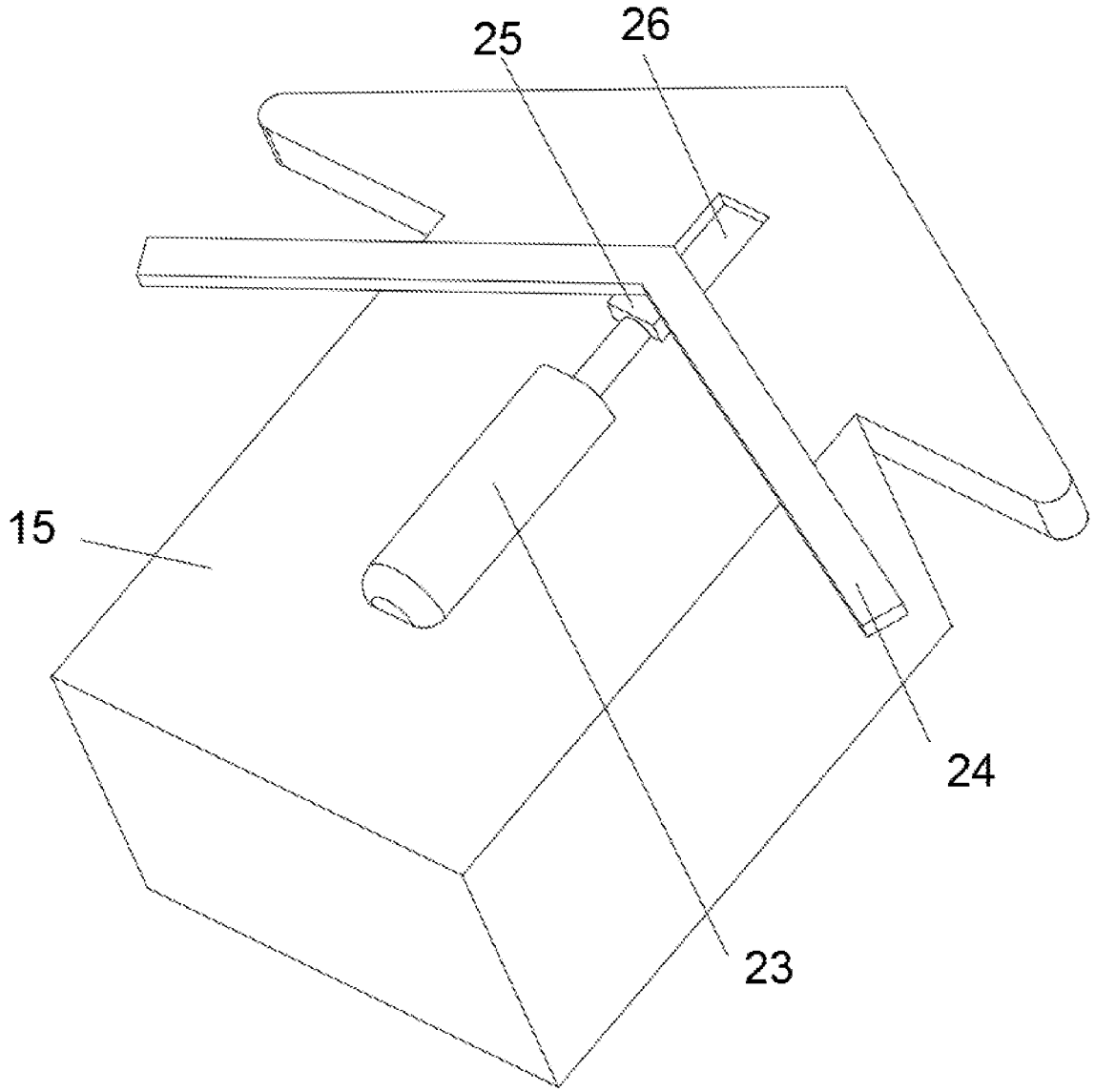
FIG. 8 illustrates a schematic structural diagram of a movable plate of the disclosure.

Referring to FIG. 1 to FIG. 8, the disclosure provides a technical solution: a robot for pond desilting, which includes a frame 2. An end of the frame 2 is provided with a pressure-resistant cabin 1. A motor 30 is disposed in the pressure-resistant cabin 1. Ends of the motor 30 are connected to power wheels 10 respectively. A sealing rubber ring 13 and a sealing cabin cover 14 are disposed on the pressure-resistant cabin 1. The sealing rubber ring 13 and the sealing cabin cover 14 are fixed on the pressure-resistant cabin 1 through screws 32 (FIG. 4 shows only one of the screws 32 to show other parts clearly). Tracks 8 (for example, caterpillars) are sleeved on the power wheels 10 respectively. Tension wheels 7 and bearing wheels 9 are disposed on the frame 2. The tension wheels 7 and the bearing wheels 9 are rotatably connected to the frame 2. The tracks 8 are sleeved on the tension wheels 7 and the bearing wheels 9. The tension wheels 7 and the bearing wheels 9 are configured to rotate besides the frame 2, the tracks 8 are configured to rotate on surfaces of the tension wheels 7, surfaces of the bearing wheels 9, surfaces of the power wheels 10. Bottoms of the tracks 8 contact the bottom of the pond when the robot is in use.

Furthermore, a lead screw base 11 is disposed on the lead screw sliding table 5. A rotary lead screw 12 is disposed on the lead screw sliding table 5. The lead screw base 11 is disposed on the rotary lead screw 12. The lead screw sliding table 5 is connected to the frame 2. Waterproof motors 6 are disposed above the lead screw base 11. A pump body 3 is disposed in the frame 2. The lead screw sliding table 5 is fixed on another end of the frame 2. Limited sliding rails 27 are disposed on the lead screw sliding table 5. The lead screw base 11 is provided with limited grooves 28. The limited sliding rails 27 are matched with the limited grooves 28. The lead screw base 11 is configured to slide on the lead screw sliding table 5, the rotary lead screw 12 is configured for connecting to a driving device, and the driving device is configured to drive the rotary lead screw 12 to slide on the lead screw sliding table 5. The rotary lead screw 12 is disposed between the lead screw base 11 and the lead screw sliding table 5. The rotary lead screw 12 is configured to rotate to drive the lead screw base 11 to move on the lead screw sliding table 5. The waterproof motors 6 are disposed above the lead screw base 11. An end of each of the waterproof motors 6 is provided with a reamer 29, and the waterproof motor 6 is configured to rotate the reamer 29.

The suction pipe 4 is disposed at an end of the pump body 3. Another end of the pump body 3 is configured for connecting to a pipeline, and the pipeline is configured to extend outside a pond when the robot for pond desilting is operated in the pond. An end of the suction pipe 4 is provided with a filter 31, the pump body 3 is configured to pump silt and water into the suction pipe 4, and the silt and the water are discharged through the pipeline. In an embodiment, the pump body may be a submersible slurry pump with the model number 50ZJQ25-15.

A triangular plate 16 is disposed on the extension block 15. A section of the triangular plate 16 is triangular. A bottom of the triangular plate 16 is provided with multiple barrier rods 17. A section of each of the multiple barrier rods 17 includes a triangle and a semicircle, and the multiple barrier rods 17 are evenly arranged at the bottom of the triangular plate 16. A bottom of each of the multiple barrier rods 17 is provided with a casing pipe 21. A bottom of the casing pipe 21 is provided with a ball 20. The casing pipe 21 is provided with an inserting groove 18. The bottom of the barrier rod 17 is inserted in the inserting groove 18. The barrier rod 17 is configured to move in the inserting groove 18, and a spring 19 is disposed in the inserting groove 18. An end of the spring 19 is connected to the bottom of the barrier rod 17, and another end of the spring 19 is connected to an inner wall of the insertion groove 18. A bottom of the extension block 15 is provided with a waterproof cylinder 23. An end of the waterproof cylinder 23 is connected to a sliding block 25. The bottom of the extension block 15 is provided with a sliding groove 26, the sliding block 25 is located in the sliding groove 26, and the sliding block 25 is configured to move in the sliding groove 26. A movable plate 24 is disposed on the sliding block 25. The movable plate 24 is provided with multiple push plates 22, and a part of the each of the multiple push plates 22 is arc-shaped.

When the robot of the disclosure is placed at the bottom of the pond, the motor 30 inside the pressure-resistant cabin 1 drives the power wheels 10 to rotate, the power wheels 10 drive the tracks 8 to rotate around the power wheels 10, bearing wheels 9, and tension wheels 7, thereby driving the frame 2 to move. During the movement of the robot at the bottom of the pond, the waterproof motors 6 drive the reamers 29 to rotate for crushing the silt at the bottom of the pond. Then, the pump body 3 sucks the silt out of the pond through the suction pipe 4, and the waterproof motors 6 are installed above the lead screw base 11, so that the waterproof motors 6 can be lifted and lowered by moving the lead screw base 11 on the lead screw sliding table 5, which facilitates the insertion of the reamers 29 into the silt to crush the silt. The waterproof motors 6 are located at the rear of the frame 2 to prevent the robot from getting stuck and unable to move. The disclosure can clear the silt from the pond without affecting the normal farming of fishes and shrimps. The barrier rods 17 can block the stones in the silt, and after the waterproof cylinder 23 drives the movable plate 24 to move, the movable plate 24 will push the stones stuck between the barrier rods 17 to prevent the stones from getting stuck in the reamers 29.

Although illustrative embodiment of the disclosure have been described above to enable those skilled in the art to understand the disclosure, the disclosure is not limited to the scope of the embodiments. For those skilled in the art, as long as various variations are within the spirit and scope of the disclosure as defined and determined by the attached claims, all application creations using the concept of the disclosure should be protected.

What is claimed is:

1. A robot for pond desilting, comprising: a frame (2), a lead screw sliding table (5), and a suction pipe (4);

wherein an end of the frame (2) is provided with a pressure-resistant cabin (1), a lead screw base (11) is disposed on the lead screw sliding table (5), a rotary lead screw (12) is disposed on the lead screw sliding table (5), the lead screw sliding table (5) is connected to the frame (2), the lead screw base (11) is disposed on the rotary lead screw (12), waterproof motors (6) are disposed above the lead screw base (11), a pump body (3) is disposed in the frame (2), and the suction pipe (4) is disposed at an end of the pump body (3);

wherein a motor (30) is disposed in the pressure-resistant cabin (1), and ends of the motor (30) are connected to power wheels (10) respectively; a sealing rubber ring (13) and a sealing cabin cover (14) are disposed on the pressure-resistant cabin (1), and the sealing rubber ring (13) and the sealing cabin cover (14) are fixed on the pressure-resistant cabin (1) through screws (32); and tracks (8) are sleeved on the power wheels (10) respectively, and tension wheels (7) and bearing wheels (9) are disposed on the frame (2).

2. The robot for pond desilting as claimed in claim 1, wherein the tension wheels (7) and the bearing wheels (9) are rotatably connected to the frame (2), the tracks (8) are sleeved on the tension wheels (7) and the bearing wheels (9), and the tension wheels (7) and the bearing wheels (9) are configured to rotate beside the frame (2); the tracks (8) are configured to rotate on surfaces of the tension wheels (7), surfaces of the bearing wheels (9), and surfaces of the power wheels (10); and bottoms of the tracks (8) are configured for being in contact with a bottom of a pond when the robot for pond desilting is operated in the pond.

3. The robot for pond desilting as claimed in claim 1, wherein another end of the pump body (3) is configured for connecting to a pipeline, and the pipeline is configured to extend outside a pond when the robot for pond desilting is operated in the pond; an end of the suction pipe (4) is provided with a filter (31); and the pump body (3) is configured to pump silt and water into the suction pipe (4), and the silt and the water are discharged through the pipeline.

4. The robot for pond desilting as claimed in claim 2, wherein the lead screw sliding table (5) is fixed on another end of the frame (2), and limited sliding rails (27) are disposed on the lead screw sliding table (5); the lead screw base (11) is provided with limited grooves (28), and the limited sliding rails (27) are matched with the limited grooves (28); and the lead screw base (11) is configured to slide on the lead screw sliding table (5), the rotary lead screw (12) is configured for connecting to a driving device, and the driving device is configured to drive the rotary lead screw (12) to slide on the lead screw sliding table (5).

5. The robot for pond desilting as claimed in claim 4, wherein the rotary lead screw (12) is disposed between the lead screw base (11) and the lead screw sliding table (5), the rotary lead screw (12) is configured to rotate to drive the lead screw base (11) to move on the lead screw sliding table (5), an end of each of the waterproof motors (6) is provided with a reamer (29), the waterproof motor (6) is configured to rotate the reamer (29), and an extension block (15) is disposed on the lead screw base (11).

6. The robot for pond desilting as claimed in claim 5, wherein a triangular plate (16) is disposed on the extension block (15), a section of the triangular plate (16) is triangular, a bottom of the triangular plate (16) is provided with a plurality of barrier rods (17), a section of each of the plurality of barrier rods (17) comprises a triangle and a semicircle, and the plurality of barrier rods (17) are evenly arranged at the bottom of the triangular plate (16).

7. The robot for pond desilting as claimed in claim 6, wherein a bottom of each of the plurality of the barrier rods (17) is provided with a casing pipe (21), a bottom of the casing pipe (21) is provided with a ball (20), the casing pipe (21) is provided with an inserting groove (18), the bottom of the barrier rod (17) is inserted in the inserting groove (18), the barrier rod (17) is configured to move in the inserting groove (18), and a spring (19) is disposed in the inserting groove (18).

8. The robot for pond desilting as claimed in claim 7, wherein an end of the spring (19) is connected to the bottom of the barrier rod (17), another end of the spring (19) is connected to an inner wall of the inserting groove (18), a bottom of the extension block (15) is provided with a waterproof cylinder (23), an end of the waterproof cylinder (23) is connected to a sliding block (25), the bottom of the extension block (15) is provided with a sliding groove (26), and the sliding block (25) is located in the sliding groove (26), and the sliding block (25) is configured to move in the sliding groove (26).

9. The robot for pond desilting as claimed in claim 8, wherein a movable plate (24) is disposed on the sliding block (25), and the movable plate (24) is provided with a plurality of push plates (22).

* * * * *